US012577074B2

(12) United States Patent
Vandenbergh et al.

(10) Patent No.: US 12,577,074 B2
(45) Date of Patent: Mar. 17, 2026

(54) MEDIA STACKER

(71) Applicant: Hewlett-Packard Development Company, L.P., Spring, TX (US)

(72) Inventors: Kurt Annete M. Vandenbergh, Sant Cugat del Valles (ES); Francesc Gil I Fossas, Sant Cugat del Valles (ES); Javier Deocon Mir, Sant Cugat del Valles (ES)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 90 days.

(21) Appl. No.: 18/575,427

(22) PCT Filed: Jul. 2, 2021

(86) PCT No.: PCT/US2021/040326
§ 371 (c)(1),
(2) Date: Dec. 29, 2023

(87) PCT Pub. No.: WO2023/277927
PCT Pub. Date: Jan. 5, 2023

(65) Prior Publication Data
US 2024/0308809 A1 Sep. 19, 2024

(51) Int. Cl.
*B65H 29/34* (2006.01)

(52) U.S. Cl.
CPC ..... *B65H 29/34* (2013.01); *B65H 2402/31* (2013.01)

(58) Field of Classification Search
CPC ..... B65H 29/34; B65H 2402/31
See application file for complete search history.

(56) References Cited

U.S. PATENT DOCUMENTS

| | | | | |
|---|---|---|---|---|
| 3,690,475 | A | 9/1972 | Pfaffle | |
| 4,844,633 | A * | 7/1989 | Greenberg | B41J 13/106 271/189 |
| 6,238,114 | B1 * | 5/2001 | Bennett, III | B65H 29/34 400/625 |
| 2007/0114714 | A1 | 5/2007 | Kinoshita et al. | |
| 2014/0225967 | A1 | 8/2014 | Orue et al. | |
| 2016/0340142 | A1 | 11/2016 | Chanclon et al. | |
| 2020/0156894 | A1 * | 5/2020 | Tsuchiya | B65H 31/10 |

FOREIGN PATENT DOCUMENTS

| | | | |
|---|---|---|---|
| WO | 95/11184 | A1 | 4/1995 |
| WO | 2017/092786 | A1 | 6/2017 |

* cited by examiner

*Primary Examiner* — Thomas A Morrison
(74) *Attorney, Agent, or Firm* — Jordan IP Law, LLC

(57) ABSTRACT

A media stacker may comprises a stacking platform; and a pair of a guiding tracks above the stacking platform and extending from a media receiving side of the media stacker in a media advance direction along opposite sides of a media transport path; wherein at least one guiding track of the pair of guiding tracks is movable between a support position and a release position to guide and support the media sheet above the stacking platform and to release the media sheet to drop from the guiding track to the stacking platform.

13 Claims, 5 Drawing Sheets

MEDIA STACKER

BACKGROUND

A media stacker may be used to stack media, for example, media sheets output by a printer. In some examples, media may comprise sheets of material, such as paper, cardboard, plastics or the like, which may be relatively thick. A stacker may comprise a feed mechanism and a stacking platform to convey media sheets and support a stack of media sheets, for example for retrieval by a user.

BRIEF DESCRIPTION OF DRAWINGS

Examples will now be described with reference to the accompanying drawings, in which.

DETAILED DESCRIPTION

Figure 1:
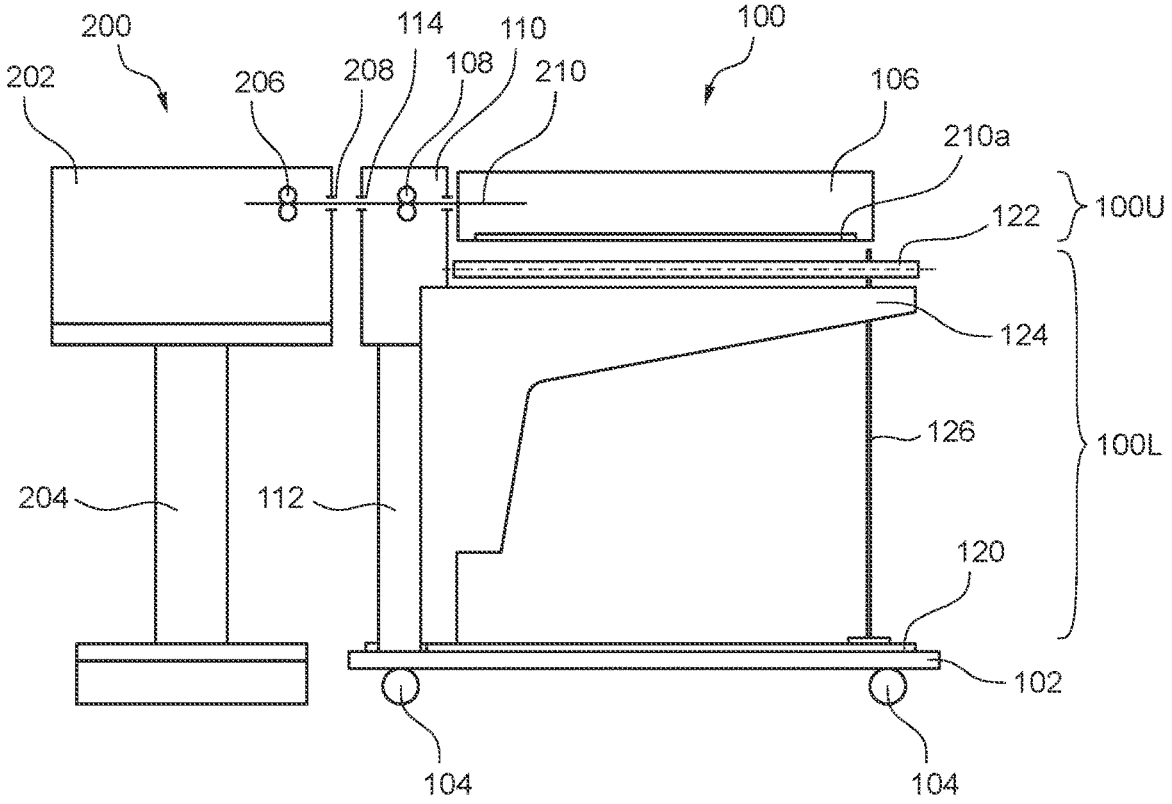
FIG. 1 shows a schematic drawing of a media stacker in combination with a printer, according to an example.

This disclosure relates to a media stacker for media sheets, in particular sheets of a print medium. The following examples relate to a media stacker and, more particularly, a print media stacker which may be used in combination with a printer, in particular a large format printer which is designed to print on media sheets having a DIN A3 and larger format. The following examples further relate to a media stacker having a high stack capacity, such as a stack capacity above 50 mm and up to 500 mm and beyond, e.g. up to 1 m. A high stack capacity may be particularly efficient when stacking media sheets of relatively large thickness, such as boards or plates having a thickness of more than 1 mm, more than 2 mm, or more than 5 mm or up to 10 mm and beyond. The media stacker also may be designed to process relatively rigid media sheets, such as boards and plates being inherently stable and exiting a printer output while maintaining a substantially horizontal orientation. The media stacker also may be designated as a high volume horizontal media stacker. The media sheet thickness and stiffness also may depend on the printing capacity of the printer.

Media sheets processed by the media stacker e.g. may have a thickness in the range of 1 to 10 mm and/or a density in the range of 500 to 1500 g/mm3 and/or a Young modulus in the range of 80 to 30000 MPa, for example. The media sheets may be made of or include paper, cardboard, wood or wood-like materials and/or plastic sheets, they may comprise a sandwich construction having a porous core laminated with one or more paper, cardboard or plastic cover layers and they may be coated on one or two sides, for example.

The media stacker further may be designed to transfer printed media sheets from a printer output to a media sheet stack by dropping a subsequent printed media sheet on a previous printed media sheet in such a way that the falling subsequent printed media sheet is guided to remain at least approximately horizontally aligned while falling vertically. As a result, a subsequent printed media sheet is not sliding over the surface of a previous printed media sheet. Further, the media stacker may be designed to ensure that, when dropping the subsequent printed media sheet on the previous printed media sheet, the media sheets overlap and are at least approximately aligned. This minimize the friction between subsequent media sheets being stacked and previous ones already stacked and hence minimizes the risk of marking, scratching or otherwise damaging surfaces, in particular printed surfaces of stacked media sheets. This allows stacking printed media sheets having sensitive surface, such as coated board and plates, without damaging the surface The media stacker of this disclosure may be designed as a refit device or an upgrade device of an existing stacker device or may be a separate new stacker device. The media stacker of this disclosure further may be designed as a passive media stacker, including no motors or other powered drives and/or no active sensors, e.g. no sending and/or receiving sensors.

FIG. 1 shows a schematic drawing of a media stacker 100 in combination with a printer 200 in a side view, according to an example. The printer 200 is schematically illustrated to have a printer housing 202 carried by a printer support 204. The printer 200 may be in particular a large format printer, XL printer or XXL printer which is designed to print on media sheets having a DIN A3 and larger format. The printer 200 may have suitable print media transport and printing components and may be an inkjet printer or an electrophoretic or thermal printer, for example. These components are not shown in any detail in FIG. 1. FIG. 1 illustrates a pair of output rollers 206 to output a print media sheet 210 from a printer output 208.

The media stacker 100 of the example of FIG. 1 is associated with the printer 200 and may be a trolley mounted stacker 100 which may be rolled up to the printer 200 to be used there with. Such a media stacker 200 may be referred to as a printer accessory or printer finisher or the like. For moving the media stacker 100, it may be provided with a support frame 102 carried by rollers 104.

The media stacker 100 of FIG. 1 comprises an upper stacking unit 100U and a lower stacking unit 100L which may be operated selectively and alternatively.

In the example of FIG. 1, the upper stacking unit 100U comprises a stacking tray 106 and a feed mechanism 108 which, in this example, comprise a pair of feed rollers. The feed mechanism 108 may be located in a stacker housing 110 which is supported on the support frame 102 by a support column 112. The feed mechanism 108 may be passively driven by the print media sheet 210 exiting the printer output 208, through the driving force of the output rollers 206 of the printer 200. An input 114 and an output 116 of the stacker housing 110, together with the feed mechanism 108, may guide the print media sheet with a horizontal or substantially horizontal orientation from the printer 200 to the stacking tray 106.

The stacking tray 106 may receive a number of print media sheets and may hold a print media stack having a height of up to 50 mm, for example. In an example where media sheets having a thickness of about 10 mm are received, the stacking tray 106 may hold up to 5 media sheets, for example. The upper stacking unit 100U may be considered a low-volume stacking unit.

When the media sheet 210 is fed to the stacking tray 106, a leading edge of the media sheet 210 may bend down to the surface of a media sheet 210*a* previously stacked on the tray 106 and may create friction on the surface which may lead to scratches or marks. This may damage in particularly a sensitive printed and/or coated surface of the media sheet 210.

The stacking tray 106 may be removable from the stacker housing 110 and can be stored at the media stacker 100 or separate there from. The upper stacking unit 100U including the stacking tray 106 also may be omitted, leaving the lower stacking unit 100L.

Figure 2:
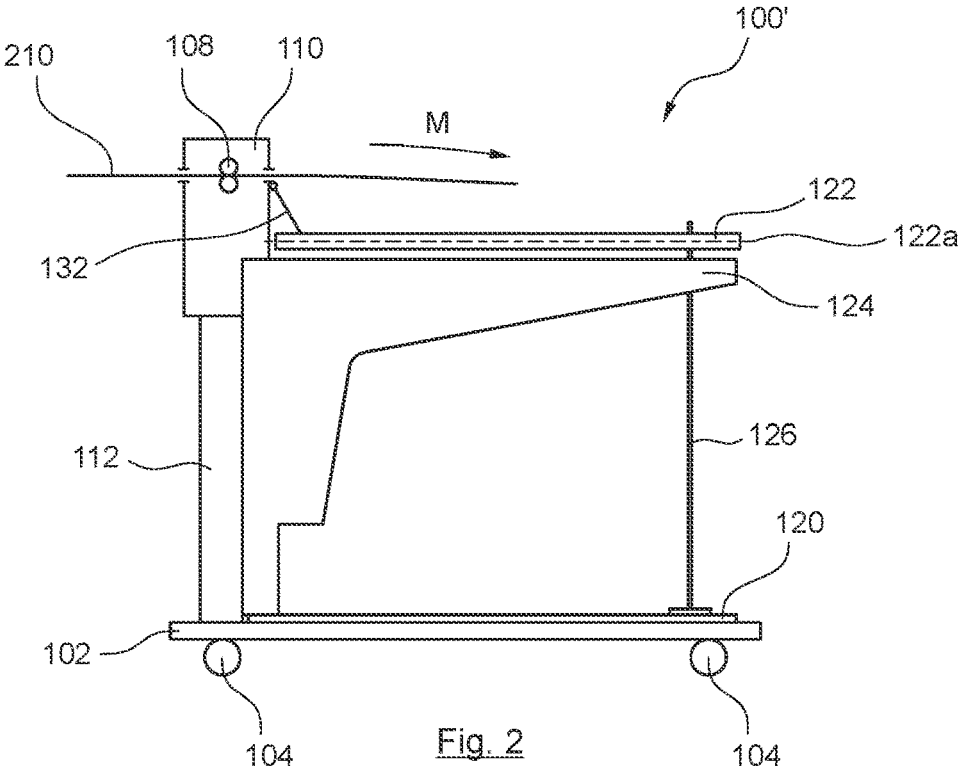
FIG. 2 shows a schematic drawing of the media stacker of FIG. 1, according to an example.

FIG. 2 shows a schematic drawing of a media stacker 100' comprising the lower stacking unit 100L but not the upper stacking unit 100U of FIG. 1, according to an example. In other words, a stacking tray, such as the stacking tray 110, has been removed or the media stacker 100' does not have a stacking tray. The media stacker 100' of FIG. 2 may be used in combination with a printer, such as the printer 200 shown in FIG. 1. The printer may be in particular a large format printer, XL printer or XXL printer which is designed to print on media sheets having a DIN A3 and larger format. The printer may have suitable print media transport and printing components and may be an inkjet printer or an electrophoretic or thermal printer, for example.

Also the media stacker 100' of the example of FIG. 2 may be a trolley mounted stacker which may be designed to be rolled up to a printer to be used there with. Such a media stacker may be referred to as a printer accessory or printer finisher or the like. The media stacker 100' of FIG. 2 may be configured in the same or a similar way as the media stacker 100 of FIG. 1, except that the stacking tray 106 is omitted. Corresponding parts are designated by the same reference numbers and reference is made to the description of FIG. 1 above. For moving the media stacker 100', it may be provided with a support frame 102 carried by rollers 104.

The components of the media stacker 100', which in the following are described with reference to FIG. 2, also may also be present in the media stacker 100 of FIG. 1; in particular, in the lower stacking unit 100L. Accordingly, the media stacker 100 of FIG. 1 and the media stacker 100' of FIG. 2 may operate in the same or a similar way if the upper stacking unit 100U is removed from the media stacker 100 of FIG. 1. For ease of description and clarity, the components and operation of the stacking unit 100L of the media stacker 100 is described with reference to FIG. 2, with the understanding that this description also may be applied to the media stacker 100 of FIG. 1.

The media stacker 100' in the example of FIG. 2 comprises a stacking platform 120 which is supported by the support frame 102 to receive a stack of media sheets 210 from an associated printer. The stacking platform 120 may be or may include a palette or may include a different type of stacking plate or frame. A pallet or another type of stacking platform may be designed to be easily removable from the media stacker 100' once a pile of media sheets has been stacked thereon.

The media stacker 100' further comprises a pair of guiding tracks 122 above the platform 120 which are extending from the stacker housing 110, which receives the media sheet from the printer, in a media advance direction M along opposite sides of a media transport path. The media transport path is defined between the pair of guiding tracks 122 and a width of the media transport path extends in a direction perpendicular to the media advance direction M. The side view of FIG. 2 illustrates one of the pair of guiding tracks 122, extending along one side of the media transport path. At least one guiding track of the pair of guiding tracks 122 is movable between a support position and a release position to guide and support the media sheet 210 above the stacking platform 120 and to release the media sheet 210 to drop from the guiding tracks 122 to the stacking platform 120, as described in further detail below.

Additionally, in some examples, one or both of the guiding tracks 122 may be adjustable in its position relative to the width of the media transport path to adjust the spacing between the guiding tracks 122 for accommodating media sheets 210 of different width.

The media stacker 100' in the example of FIG. 2 further comprises a number of adjustable guide plates extending between the platform 120 and the pair of guiding tracks 122 wherein the adjustable guide plates are to define a chute adjustable in width and length to guide a media sheet 210 dropping from the pair of guiding tracks 122 to the platform 120. FIG. 2 illustrates a left-side guide plate 124 and a left-hand front guide plate 126, as seen in the viewing direction opposite to the media advance direction M. There further may be provided a right-side guide plate and a right-hand front guide plate, which are hidden behind the left-side guide plate 124 and the left-hand front guide plate 126 in the side view of FIG. 2. There further may be provided rear-side guide plates, as described in further detail below. The side guide plates and front guide plates may be adjustable to adapt the width and length of the chute to the width and length of the media sheet 210.

For the purposes of this description, the downstream side of the media stacker 100, 100', in the media advance direction M, on the left-hand side in FIGS. 1 and 2, is designated as rear side; the upstream side of the media stacker 100, 100', on the right-hand side in FIGS. 1 and 2, is designated as front side; and the two opposite sides of the media transport path are designated as left-hand side and right-hand side of the media stacker 100, 100'. In FIGS. 1 and 2, the left-hand side of the media stacker 100, 100' is shown.

The media stacker 100' in the example of FIG. 2 further comprises a movable ramp 132 to guide the media sheet 210 onto the pair of guiding tracks 122. In one example, there may be a pair of movable ramps at the left-hand side and the right-hand side of the media transport path. The movable ramp(s) 132 may be movable from a stored position to an operating position (shown in FIG. 2) for guiding the print media sheet 210 and, in particular, a trailing edge of the print media sheet, as described in further detail below.

In the example of FIG. 2, at least one of the guiding tracks 122 may be rotatable or pivotable around an axis 122*a* that is parallel to the media advance direction M. One or both of the guiding tracks 122 may be designed such that they rotate or pivot between a support position, supporting the media sheet 210, and a release position in which the media sheet 210 is released from the guiding tracks 122 to drop onto the platform 120. In another example, at least one of the guiding tracks 122 may be designed to move sideways between a support position, supporting the media sheet 210, and a release position in which the media sheet to 210 is released from the guiding tracks 122 to drop onto the platform 120.

The guide plates 124, 126 may form a chute to guide the media sheet 210 while dropping from the guiding tracks 122 to the platform 120. The movable guiding tracks 122 and the guide plates 124, 126 guide the media sheet 210 in such a way that it remains horizontally aligned or about horizontally aligned while falling vertically so that the leading edge of the media sheet 210 or any other edge thereof will not contact a printed surface area of a previously stacked media sheet resting on the platform 120. This may help to avoid a subsequent printed media sheet damaging a previous printed media sheet, e.g. by scratching or rubbing against the surface of the previous printed media sheet.

The platform 120 may receive a number of print media sheets and may hold a print media stack having a height of up to 500 mm or up to 1 m, for example. In an example where media sheets having a thickness of about 10 mm are received, the platform 120 may hold up to 50 or up to 100 media sheets, for example. The media stacker 100' of FIG. 2 and the lower stacking unit 100L of FIG. 1 may be considered a high-volume media stacker or stacking unit.

The media stacker 100, 100' further may be described as a passive media stacker in that the guiding tracks 122 are actuated to rotate or move sideways by gravity force of the media sheet 210 being fed and dropping onto the guiding tracks 122 as described in further detail below. In some examples, no active drive motor and/or no sensors are provided.

The media stacker 100' further may comprise a latch device associated with the guiding track(s) 122 to be actuated by the media sheet 210 physically engaging with the latch device, as described in further detail below. For example, the latch device may be provided on the surface of the guiding track(s) 122 and may be actuated by a trailing edge of the media sheet 210 being fed and dropping onto the guiding track(s) 122 and hence also on the latch device to release a lock. This allows movement of the guiding track(s) 122, e.g. to rotate, pivot or move sideways, which is driven by gravity force of the media sheet 120 acting against the guiding track(s) 122. Further, in this example, the trailing edge of the media sheet 210 actuating the latch device ensures that the media sheet is released from the guiding tracks 122 after the entire sheet 210 has been fed from the feeder mechanism 108 of the stacker 100' onto the guiding tracks 122 and the media sheet 210 is horizontally aligned when released.

A further example of a media stacker 300 is shown and described with reference to FIGS. 3 to 8. Some components of the media stacker 300 correspond to those of the previously described media stackers 100, 100' in that they are similar in design and/function and these corresponding components are designated by corresponding reference numbers, starting with "3" instead of "1." The use of corresponding reference numbers may imply that corresponding components have corresponding functionalities, without limitation thereto. Accordingly, reference is made to the above description of FIGS. 1 and 2, which also applies to the example of FIGS. 3 to 8 where appropriate.

The media stacker 300 may be used in combination with a printer, such as a large format printer having a printer output. The printer may be designed to process and print on media sheets of relatively high thickness and/or rigidity, as described above. The media stacker 300 may be a trolley mounted stacker which may be rolled up to a printer output to receive printed media sheets therefrom. For moving the media stacker 300, it may be provided with a support frame 302 carried by rollers 304. Additionally, the support frame 302 may be provided with adjustable legs 303, a break (not shown) and the like.

The media stacker 300 of this example comprises a stacking tray 306, corresponding to the upper stacking unit 100U of FIG. 1, and a passive high-volume stacking unit 300', shown in FIGS. 4 to 7 and corresponding to the lower stacking unit 100L of FIG. 1. As in the example of FIGS. 1 and 2, the stacking tray 306 may be removable and/or may be omitted. Accordingly, the passive high-volume stacking unit 300' may be the same as the media stacker 300, with the stacking tray 306 removed, or maybe a different device not having a stacking tray.

The stacking tray 306 of this example may provide a receiving surface for a limited number of printed media sheets which are fed from the printer output through a stacker housing 310 to which the stacking tray 306 may be removably attached. The stacker housing 310 may include feed rollers or another feed mechanism 308 which may be passively driven by the print media sheet exiting the printer output. The stacker housing 310 is supported by support columns 312*l*, 312*r*. The stacker housing 310 together with the feed mechanism 308 may guide the print media sheet with a horizontal or substantially horizontal orientation from the printer to the stacking tray 306. The stacking tray 306 may receive a number of print media sheets and may hold the print media stack having a height of up to 50 mm, for example. In an example where media sheets having a thickness of about 10 mm are received, the stacking tray 106 may hold up to 5 media sheets, for example. The stacking tray 306 may be considered a low-volume stacking unit. Further reference is made to the description of FIG. 1 above.

Figure 3:
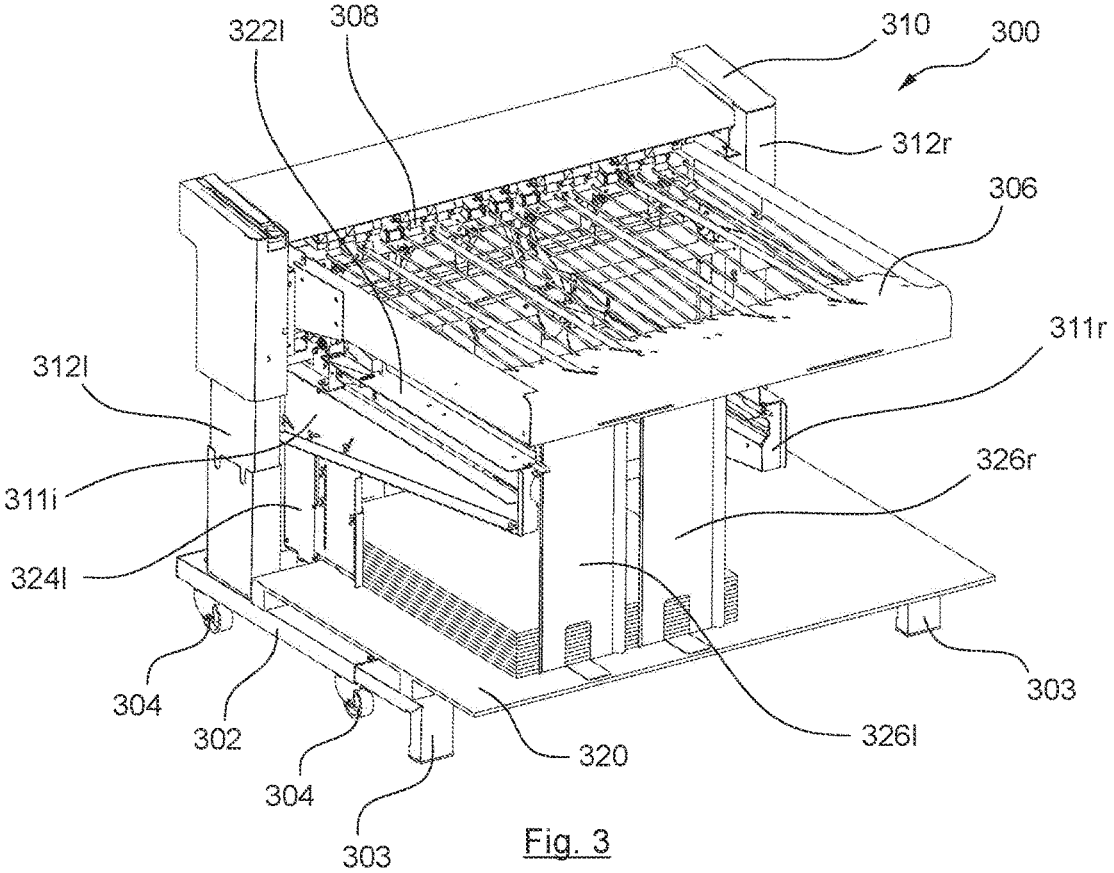
FIG. 3 shows a perspective view of a media stacker, according to another example.

The passive high-volume stacking unit 300', which may be part of the media stacker of FIG. 3 or a standalone media stacker, is described with reference to FIGS. 4 to 8, by way of example. The different views allow illustrating different aspects of this example. For ease of description, in the following, the passive high-volume stacking unit 300' is referred to as media stacker 300'.

The components of the media stacker 300', which in the following are described with reference to FIGS. 4 to 8, also may also be present in the media stacker 300 of FIG. 3. For ease of description and clarity, the components and operation of the high-volume stacking unit of the media stacker 300 is described with reference to FIGS. 4 to 8, with the understanding that this description also may be applied to the media stacker 300 of FIG. 3.

The media stacker 300' in the example of FIGS. 4 to 8 comprises a stacking platform 320 which is supported by the support frame 302 to receive a stack of media sheets from an associated printer. Reference is made to the description of FIG. 2 above.

The media stacker 300' further comprises a pair of guiding tracks 322*l*, 322*r* above the platform 320 which are extending from the stacker housing 310, which receives the media sheet from the printer, in a media advance direction M along opposite sides of a media transport path. For the purposes of this description, the downstream side of the media stacker 300, 300', in the media advance direction M, is designated as rear side; the upstream side of the media stacker 300, 300', is designated as front side; and the two opposite sides of the media transport path are designated as left-hand side and right-hand side of the media stacker 300, 300', as seen in the perspective views of FIGS. 3 to 6.

The guiding tracks 322*l*, 322*r* may be mounted to support arms 311*r*, 311*l* extending from the stacker housing 310 or the support columns 312*r*, 312*l*.

Figure 4:
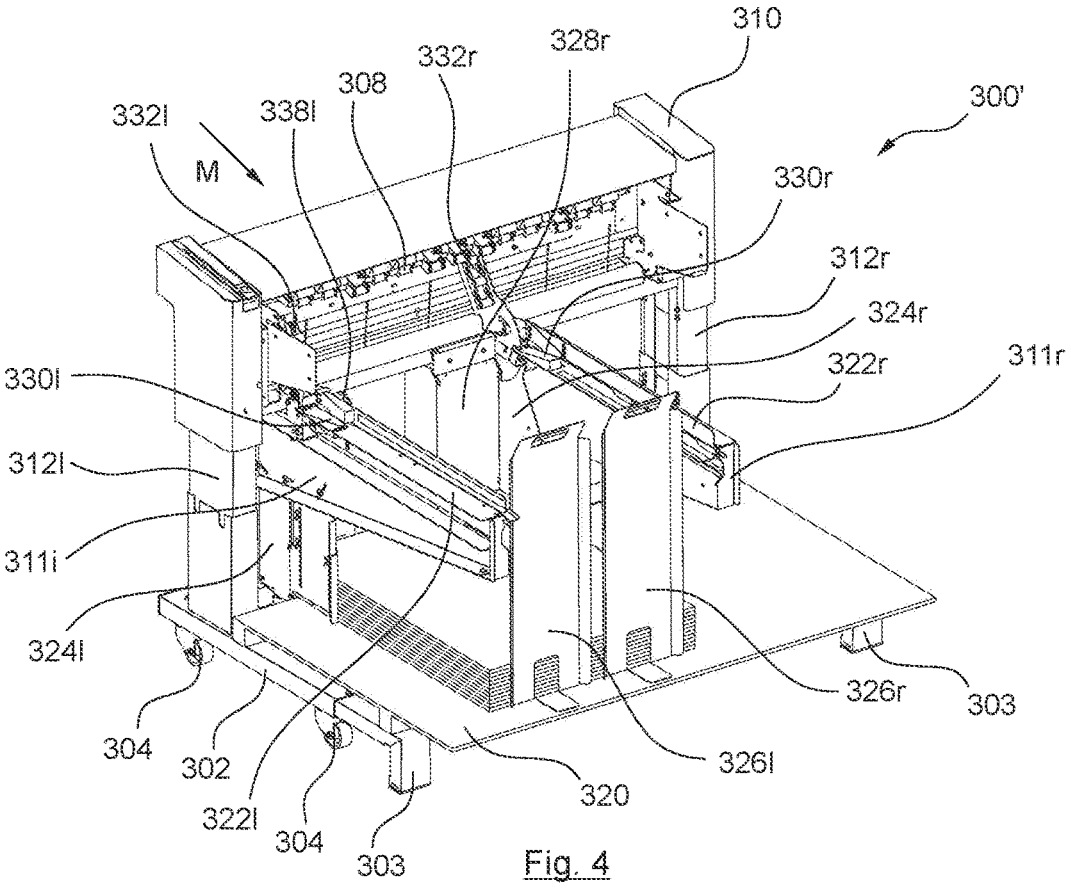
FIG. 4 shows a similar perspective view of the media stacker as FIG. 3, with some parts removed, according to an example.
Figure 5:
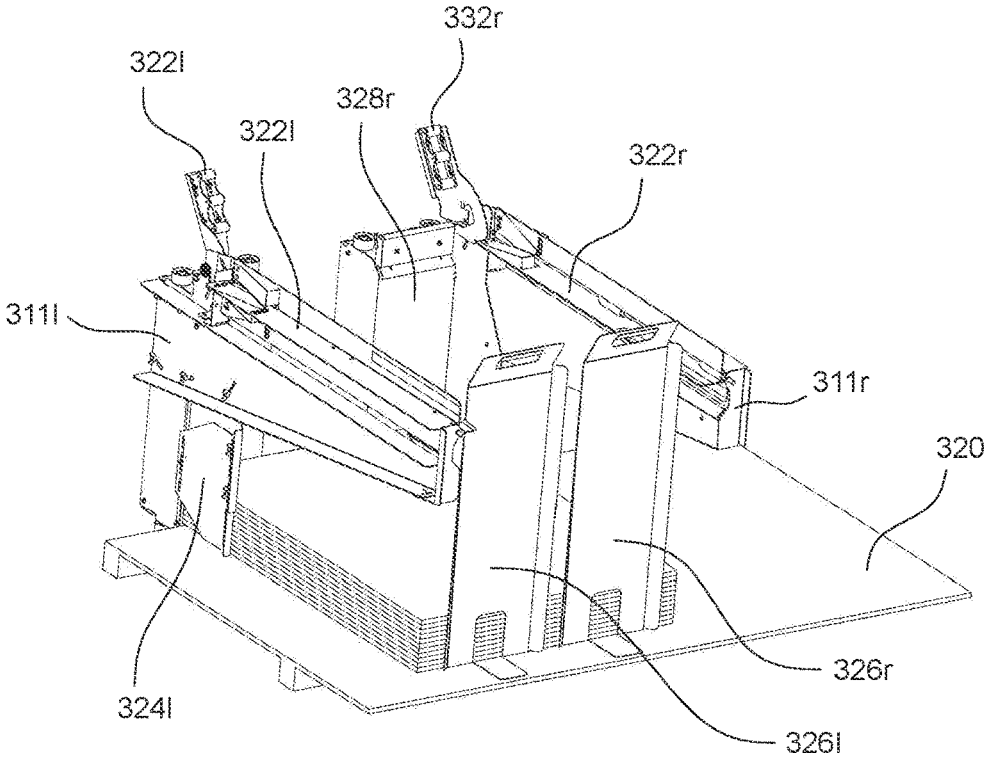
FIG. 5 shows similar perspective view of the media stacker as FIGS. 3 and 4, with more parts removed, according to an example.
Figure 6:
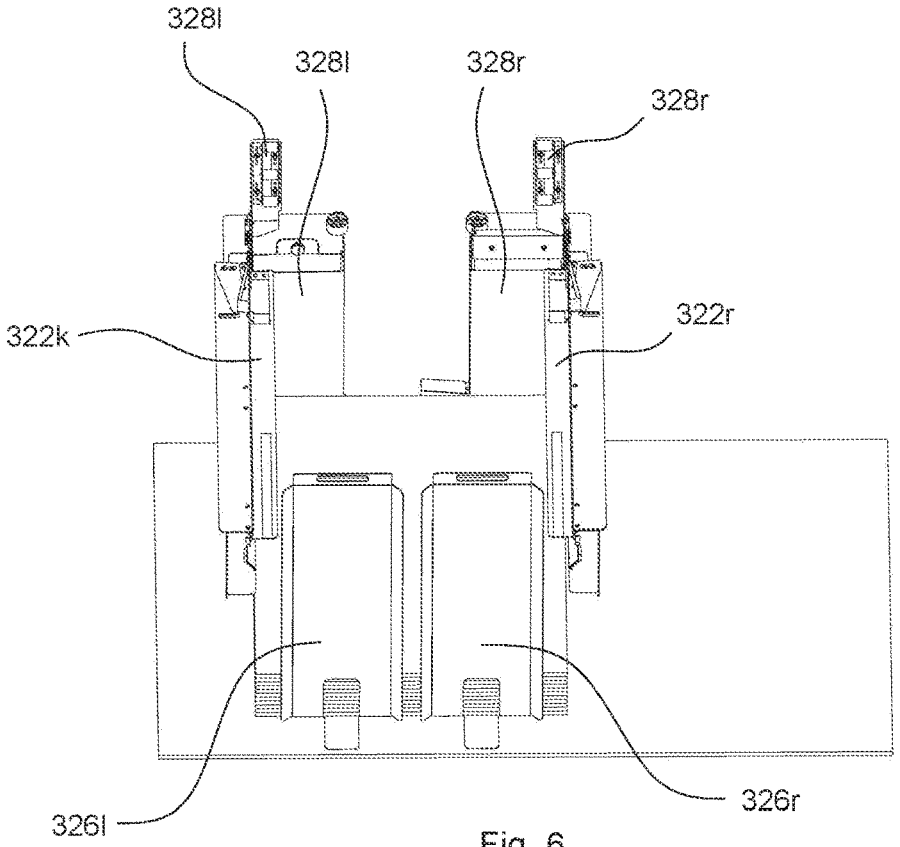
FIG. 6 shows a different perspective view of the media stacker FIG. 5 from the front and top, according to an example.
Figure 7:
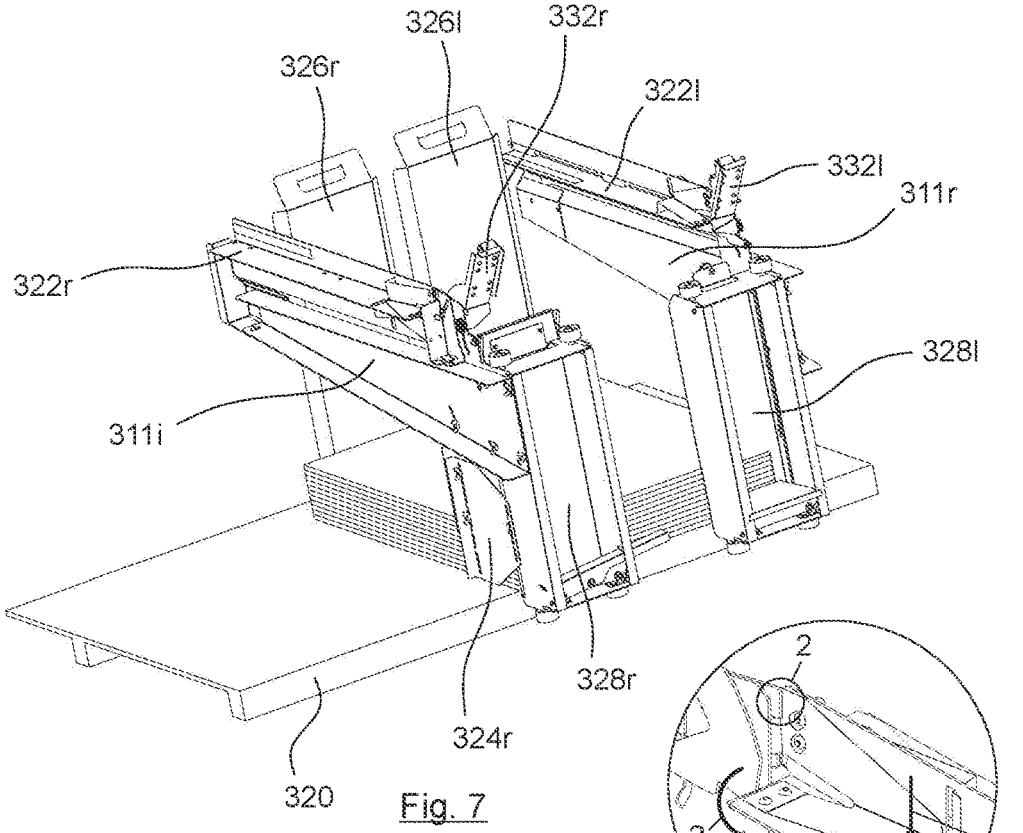
FIG. 7 shows a different perspective view of the media stacker of FIGS. 5 and 6 from the rear side, according to an example.

In this example, the right-hand guiding track 322*r* is adjustable in its position relative to the width of the media transport path to adjust the spacing between the guiding tracks 322*l*, 322*r* for accommodating media sheets 210 of different width. In the example of FIG. 4, the right-hand guiding track 322*r* is shown to be adjusted to a position between the two opposite side edges of the feed mechanism 308 to accommodate a media sheet having a width smaller than the maximum width which can be processed by the media stacker 300'.

In the example of FIGS. 4 to 8, both guiding tracks 322*l*, 322*r* are movable between a support position and a release position to guide and support the media sheet above the stacking platform 320 and to release the media sheet to drop from the guiding tracks 322*l*, 322*r* to the stacking platform 320.

In this example, each guiding track 322*l*, 322*r* is rotatable around an axis that is parallel to the media advance direction M and is part of a revolver device which is shown described in further detail with reference to FIG. 8 below. In this example, further each guiding track 322*l*, 322*r* is associated with a latch device 3301, 330*r* to block rotation of the revolver device when locked and allow rotation when released, as described in further detail with reference to FIG. 8 below. The latch device 3301, 330*r* of this example comprises a leaf spring and a look, the leaf spring to be actuated by a trailing edge of the media sheet dropping onto the leaf spring and moving the latch between a lock position and a release position.

The media stacker 300' in the example of FIGS. 4 to 8 further comprises a number of adjustable guide plates extending vertically between the platform 320 and the pair of guiding tracks 322*l*, 322*r* wherein the adjustable guide plates are to define a chute adjustable in width and length to guide a media sheet dropping from the pair of guiding tracks 322*l*, 322*r* to the platform 120. FIGS. 4 to 7 illustrate left-side and right-side guide plates 324*l*, 324*r*, left-hand and right-hand front guide plate 3261, 326*r*, and left-hand and right-hand rear guide plates 328*l*, 328*r*, as seen in the viewing direction opposite to the media advance direction M. In the example of FIGS. 4 to 8, the left-hand and right-hand rear guide plates 328*l*, 328*r*, and the left-side guide plate 324*l* are fixed in position, whereas the right-side guide plate 324*r* and the left-hand and right-hand front guide plates 3261, 326*r* may be adjustable to adapt the width and length of the chute to the width and length of the media sheet 210.

The media stacker 300' in the example of FIGS. 4 to 8 further comprises a pair of movable ramps 332*l*, 332*r* to guide the media sheet onto the pair of guiding tracks 322*l*, 332*r* on the left-hand side and on the right-hand side of the media transport path. The movable ramps 328*l*, 328*r* may be movable from a stored position to an operating position (shown in FIGS. 4 to 8) for guiding the print medium. In this example, at least the right-hand side movable ramp 328*r* may be adjustable in position along the width of the feed mechanism 308 to guide media sheets of different width along their side edges from an output of the printer as transported by the feed mechanism 308 on to the guiding tracks 322*l*,322*r* via the movable ramps 328*l*, 328*r*.

In this example, the movable ramps 328*l*, 328*r* may comprise rollers or another low friction surface, e.g. a silicone coating, to reduce friction between a lower surface of the media sheet and the movable ramps.

In the example of FIGS. 4 to 8, both of the guiding tracks 322*l*, 322*r* may be rotatable or pivotable around an axis that is parallel to the media advance direction M. In this and other examples, one or both of the guiding tracks 322*l*, 322*r* may be designed such that they rotate or pivot between a support position, supporting the media sheet, and a release position in which the media sheet is released from the guiding tracks to drop onto the platform 320. In another example, at least one of the guiding tracks may be designed to move sideways between a support position, supporting the media sheet, and a release position in which the media sheet to 210 is released from the guiding tracks to drop onto the platform. Further details are shown and described with respect to FIG. 8. The guiding tracks 322*l*, 322*r* further may be provided with an anti-friction surface, at least in parts thereof, e.g. formed by a silicone coating to reduce friction between a lower surface of the media sheet and the guiding tracks.

The guide plates 324*l*, 324*r*, 3261, 326*r*, 328*l*, 328*r* may form a chute to guide the media sheet while dropping from the guiding tracks 322*l*, 322*r* to the platform 320. The movable guiding tracks and the guide plates guide the media sheet in such a way that it remains horizontally aligned or about horizontally aligned while falling vertically so that the leading edge of the media sheet or any other edge thereof will not contact a printed surface area of a previously stacked media sheets resting on the platform. This may help to avoid a subsequent printed media sheet damaging a previously printed media sheet, e.g. by scratching or rubbing against the printed surface of the previously printed media sheet.

The platform 320 may receive a number of print media sheets and may hold a print media stack having a height of up to 500 mm or up to 1 m, for example. In an example where media sheets having a thickness of about 10 mm are received, the platform 320 may hold up to 50 or 100 media sheets, for example. The media stacker 300' of FIGS. 4 to 8, therefore, may be considered a high-volume media stacker or stacking unit.

The media stacker 300' further may be described as a passive media stacker in that the guiding tracks are actuated by gravity force of the media sheet being fed and dropping onto the guiding tracks to move the guiding tracks from a support position to a release position such as by rotating, pivoting, moving sideways or the like, as described in further detail below. In some examples, no active drive motor or sensors are provided.

Figure 8:
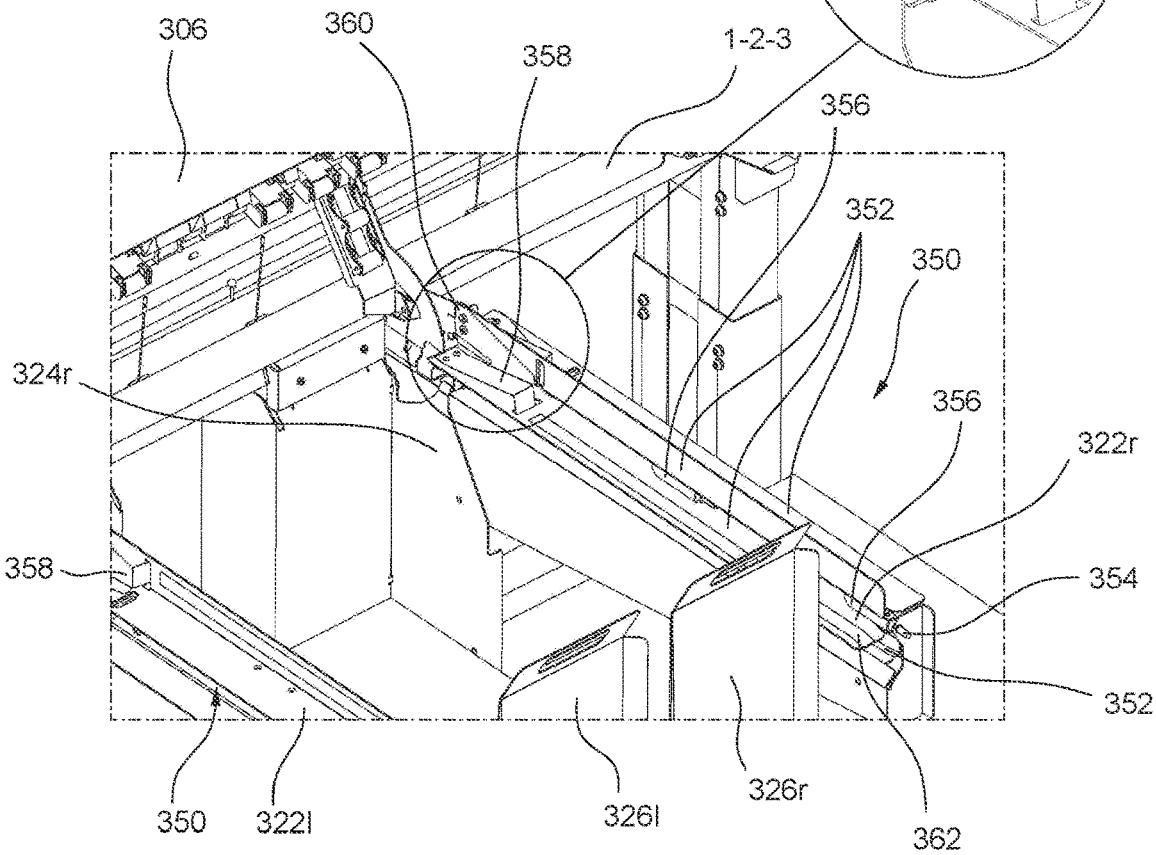
FIG. 8 shows an enlarged perspective view of a part of media stacker of FIGS. 3 to 7, according to an example.

Further details of the media stacker of FIGS. 4 to 8 according to an example are describes with respect to FIG. 8. FIG. 8 illustrates a portion of the right-hand side components of the media stacker of FIGS. 4 to 8 in an enlarged view according to an example. FIG. 8 shows part of the feed mechanism 308 in the stacker housing 306 which may be passively driven by the print media sheet exiting the printer output. The stacker housing 306 together with the feed mechanism 308 may guide the print media sheet with a horizontal or substantially horizontal orientation from the printer to the guide rails is 322*l*, 322*r* via the ramps 332*l*, 332*r*. FIG. 8 also illustrates the right-hand rear guide plate 328*r*, the right-side guide plate 324*r* and the right-hand and left-hand front guide plates 326*r*, 3261, forming a chute adjustable in width and length for receiving media sheets from the support rails 322*l* and 322*r*. In the example of FIG. 8, the right-hand and left-hand guide rails 322*r*, 322*l* are part of respective revolver devices 350, as illustrated below.

In this example, a respective revolver device 350 is provided on the left-hand side and on the right-hand side of the media transport path, each revolver device 350 including a plurality of support rails 352 extending radially from an axis 354 of rotation of the revolver device 250, the axis of rotation extending 354 in the media advance direction. in this example, each revolver device 350 includes four support rails 352 equally spaced around the axis 354 and radially extending therefrom. In another example, the number of support rails 252 could be different from four (4), such as one, two, three, or more than four. The guiding tracks 322*l*, 322*r* described above, in this example, are one of the plurality of support rails 352 of the revolver device 350 on the left-hand side and on the right-hand side of the media transport path.

The revolver devices 350 on the two sides of the media transport path are configured to rotate in a "preferred" direction, towards each other when actuated by a media sheet being released from the feed mechanism 308 and dropping on the horizontal support rails 352 extending towards the media transport path. That is, in the present example, the right hand revolver device 250 is configured to rotate anticlockwise and left hand revolver device 1250 is configured to rotate clockwise, as seen in a viewing direction opposite to the media advance direction M. Each revolver device 350 may include a spring mechanism 356 which biases the respective revolver device in its "preferred" direction. Each revolver alternatively or additionally device 350 further may include a one-way clutch which prevents rotation against the respective "preferred" direction. In other examples, the revolver devices may be to rotate in both directions and may not have one-way clutch or other mechanism to prevent rotation against the respective "preferred" direction.

In this example, each revolver device 350 further comprises a plurality of latch devices 358 associated with respective ones of the plurality of support rails 352. Each latch devices 358 may include a leaf spring, also referred to as spring lever, arranged at a respective one of the support rails 352 wherein the spring lever may be actuated, e.g. pushed down, by a trailing edge of the media sheet dropping on the support rails 352. In this example, the spring lever of the latch devices 358 is associated with, e.g. connected or integrally formed with a locking plate 360 which is actuated by the spring lever, to engage and disengage the locking plate 360 with the side guide plate 324*r* or 324*l*. In particular, in this example, when the spring lever of the latch device 358 is relaxed, the locking plate 360 protrudes from an upstream edge of the revolver device 350 to rest against an outer surface of the side guide plate 324*r*, 324*l*. The contact of the locking plate 360 with the side guide plate 324*r*, 324*l* prevents rotation of the revolver device 350 in the "preferred" direction.

Accordingly, when a media sheet is fed from the printer output via the feed mechanism 308 onto the support rails 352, and when the weight of the media sheet acts against the support rails 352, creating an initial driving force to rotate the revolver devices 350 in its "preferred" direction, rotation is blocked by the locking plate 360 of the latch device 358. However, once the trailing edge of the media sheet leaves the feed mechanism 308 and drops on the upstream end of the support rails 352, it will come into contact with and actuate the latch device 358, pushing the spring lever downwards and releasing the locking plate 360 from the engagement with the side guide plate 324*r*, 324*l*. In this situation, the revolver device 350 is free to rotate in the "preferred" direction until the latch devices 358 of the neighboring support rails 352 engage with the side guide plates 324*r*, 324*l* to again lock the revolver 350 in its position.

This is further illustrated in the again enlarged view (encircled) in FIG. 8, illustrating: (1) the spring lever of the latch device being actuated by a trailing edge of the media sheet pushing down on the spring lever, (2) the locking plate of the latch device being released from the side guide plate, and (3) the revolver device turning in the "preferred" direction to release the media sheet to drop vertically downwards towards the platform system. The ramp 332*r*, 332*l* may allow the trailing edge of the media sheet to be guided over parts of the feed and stacker mechanism and impact the latch device at the correct position. The front guide plates 326*r*, 3261 further may restrict forward movement of the media sheet in the media advance direction, when leaving the feed mechanism 308, to ensure that the trailing edge of the media sheet will drop on the latch device and the media sheet does not slide over the latch device without actuating the latch device.

In this example, the revolver devices 350 on both sides of the media transport path will then make a 90° rotation towards each other, so that the previously horizontal support rails 352 supporting the media sheet rotate towards each other and into the vertical position to let the media sheet drop vertically from the support rails 352 and onto the platform 320. Accordingly, in this example, the revolver devices 350 include four working positions, offset by 90°. The revolver devices 350 will be locked in the working position by the latch devices 358 which are released by the weight of the trailing edge of the media sheet being stacked.

As indicated above, the spring mechanism 356 may bias each revolver devices 350 in its "preferred" direction. This may serve to stably hold that revolver devices 350 in a locked position when the locking plate 360 rests against the outer surface of the side guide plate 324*r*, 324*l*. The spring mechanism 356 also may help to avoid that the revolver device 350 bounces back, in a reverse direction opposite to the "preferred" direction, after the media sheet has dropped from the support rails. A similar functionality may be achieved by a one-way clutch which may be provided in addition or alternatively to the spring mechanism.

As shown in FIG. 8, the ramps 328*r*, 328*l* and/or the support rails 352 may be provided with low friction surfaces, such as rollers, as shown for the ramps, or low friction surface coatings 362, e.g. silicone strips, as shown for the support rails 352.

In a variation of this example, one of the guide rails 322*l*, 322*r* may be fixed and the other one may be part of a revolver. In a further variation, one or both of the guide rails 322*l*, 322*r* may be movable but may have a different design such as by providing a pivoting or linearly movable guide rail. In another example, latches of two guiding tracks at the two sides of the media output could be coupled to be actuated synchronously. In a further example, a sensor to detect the print media being output from the printer and/or a motor to actuate the guiding track can be provided.

Further, in one or more examples, the guiding tracks 322*l*, 322*r* may be mounted at the opposite sides of the media transport path in such a way that they can be inclined relative to a horizontal plane. That is, the guiding tracks 322*l*, 322*r* may extend horizontally in the media advance direction or they may slope downwards (in the media advance direction) by an angle of between 0° and 20° or between 0° and 10°, for example. A downward sloping guiding tracks 322*l*, 322*r* may further reduce friction between the media sheet being fed and the surface of the guide rail. Additionally, the downward slope may enhance the gravity force applied by the media sheet. The sloping angle of the guiding tracks 322*l*, 322*r* may be fixed or may be adjustable. For example, the slope of the guiding tracks 322*l*, 322*r* can be adjusted by adjusting the mounting position and alignment of guiding tracks 322*l*, 322*r* relative to the support arms 311*r*, 311*l*.

Figure 9:
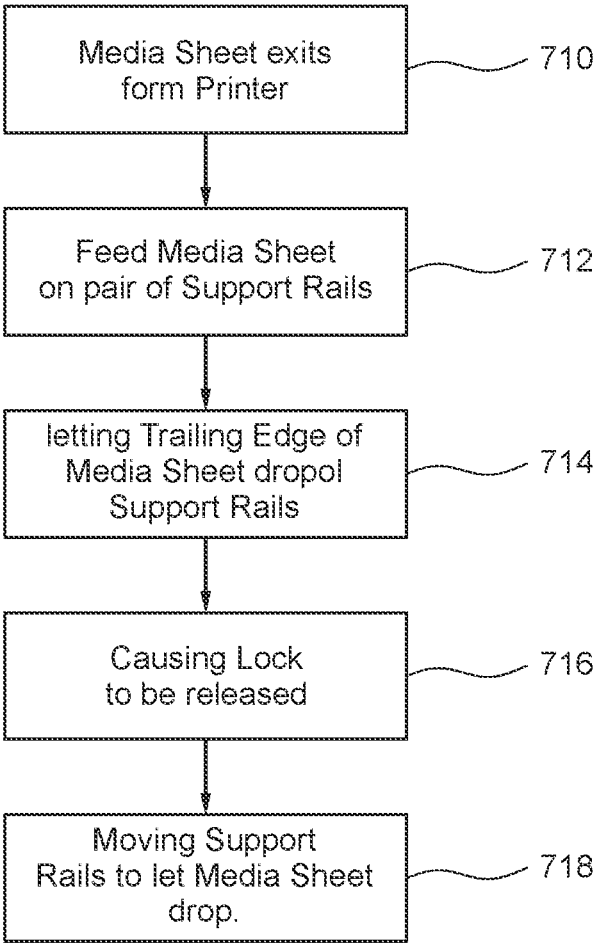
FIG. 9 is a flow chart of a method according to an example.

An example of a method of stacking print media is described with reference to FIG. 9, wherein the method may be performed using a media stacker as shown described with respect to any one of the preceding figures. Whereas the method is described with respect to FIGS. 1 to 2, it may also be applied to the media stacker of FIGS. 3 to 8. As shown in particular in FIGS. 1 and 2, a print media sheet 210 may exit from a large format printer 200, see block 910. The print media sheet may be fed from the printer output 208 to a pair of support rails 122 located along opposite sides of a media transport path, downstream of the printer output, see block 912. Feeding of the print media sheet 210 continues until a front edge of the media sheet abuts the front guide plates and a trailing edge of the print media sheet 2010 is released from the feed mechanism 108 and drops on a downstream end of the pair of support rails 122, see block 914. The dropping of the trailing edge of the print media sheet causes a lock to be released, see block 916. The releasing of the lock enables the pair of support rails 122 to move wherein movement is caused by the gravity force applied from the print media sheet 210 to the support rails 122 and wherein movement of the support rails 122 allows the print media sheet 210 to drop from the pair of support rails, see block 918.

As explained above, the media stacker of this disclosure can coexist with a stacking tray, such as shown at 106 or 306, wherein the stacking tray may be removed and stored to use the high-volume media stacker of this disclosure. The stacking tray may be stored e.g. below the platform 120, 320. After the stacking tray has been removed, the ramps 132, 332 may be moved from a stored position to an operating position and the side guide plates and front guide plates may be adjusted to provide a chute which is adapted to a media sheet size, in width and length. This allows upgrading or refitting a low-volume media stacker.

The media stacker of this disclosure also may be provided as a stand-alone new stacker device to be used in particular with large-format printers to provide a high-volume media stacker suitable for relatively rigid and relatively thick media sheets, e.g. media sheets having thickness of 1 mm and above or 5 mm and above. The stacker mechanisms may be provided to be fully passive, without use of motors or sensors, or may be combined with one or more motors and/or sensors. Conversion from a low-volume stacker, using a stacking tray, to a high-volume stacker, using the passive horizontal stacking architecture, can be performed in a minimum of time, such as 5 minutes or less.

The high-volume horizontal stacking architecture can be adjusted to media sheets of different width and length in a minimum amount of time by adjusting the position of one or both of the side guide plates and of the front guide plates as well as the position of one of the supports tracks. Because the media sheet is guided to stay horizontally or approximately horizontally aligned while dropping, the stacking architecture is scratch safe. It can be avoided that the leading edge or the sides edges of a subsequently stacked sheet rub against the printed surface of a previously stacked sheet.

The foregoing outlines features of several examples to illustrate aspects of the present disclosure. Various changes, substitutions, and combinations of the features herein disclosed can be made without departing from the scope of the present disclosure. Features of one or different examples may be combined to implement different aspects of this disclosure, while other features may be omitted.

The invention claimed is:

1. A media stacker, comprising:

a stacking platform;

a pair of a guiding tracks above the stacking platform and extending from a media receiving side of the media stacker in a media advance direction along opposite sides of a media transport path; and a latch device associated with at least one guiding track of the pair of guiding tracks, the latch device to be actuated by a media sheet physically engaging with the latch device, wherein the at least one guiding track of the pair of guiding tracks is movable between a support position and a release position to guide and support the media sheet above the stacking platform and to release the media sheet to drop from the at least one guiding track to the stacking platform, and wherein the latch device comprises a spring to be actuated by a media sheet contacting the spring.

2. The media stacker of claim 1 wherein the at least one of the guiding tracks is rotatable or pivotable around an axis that is parallel to the media advance direction.

3. The media stacker of claim 1, further comprising a number of adjustable guide plates extending between the stacking platform and the pair of guiding tracks wherein the adjustable guide plates are to define a chute adjustable in width and length to guide a media sheet dropping from the pair of guiding tracks to the stacking platform.

4. The media stacker of claim 1, further comprising a moveable ramp to guide the media sheet onto the pair of guiding tracks.

5. The media stacker of claim 4 which is a passive media stacker.

6. A media stacker, comprising:

a stacking platform;

a pair of guiding tracks above the stacking platform and extending from a media receiving side of the media stacker in a media advance direction along opposite sides of a media transport path; and a latch device associated with at least one guiding track of the pair of guiding tracks, the latch device to be actuated by a media sheet physically engaging with the latch device, wherein the at least one guiding track of the pair of guiding tracks is movable between a support position and a release position to guide and support the media sheet above the stacking platform and to release the media sheet to drop from the at least one guiding track to the stacking platform, and wherein the at least one guiding track is rotatable around an axis that is parallel to the media advance direction;

the latch device is associated with the at least one guiding track and is to block rotation when locked and allow rotation when released; and the latch device comprises a leaf spring and a lock, the leaf spring to be actuated by a trailing edge of the media sheet dropping on the leaf spring and moving the latch between a lock position and a release position.

7. The media stacker of claim 6 further comprising a one-way clutch device allowing rotation of the at least one guiding track in a direction towards the media transport path between the pair of guiding tracks, the rotation caused by the trailing edge of the media sheet dropping on the leaf spring, and preventing rotation in an opposite direction.

8. The media stacker of claim 6 comprising a revolver device, including a plurality of support rails extending radially from an axis of rotation of the revolver device, the axis of rotation extending in the media advance direction, the at least one guiding track being one of the plurality of support rails; and a plurality of latch devices associated with respective ones of the plurality of support rails.

9. A print media stacker for use with a printer, the print media stacker comprising:

a stacking platform;

a pair of a guiding tracks above the stacking platform and extending from a media receiving side of the print media stacker in a media advance direction along opposite sides of a media transport path;

a latch device associated with the pair of guiding tracks, the latch device to be actuated by a trailing edge of a media sheet;

wherein the pair of guiding tracks is pivotable between a support position and a release position to guide and support the media sheet above the stacking platform and to release the media sheet to drop from the pair of guiding tracks to the stacking platform;

wherein the latch device is to block pivoting of the pair of guiding tracks when locked and allow pivoting of the pair of guiding tracks when released; and wherein the latch device comprises a spring to be actuated by the media sheet contacting the spring.

10. The print media stacker of claim 9 wherein the media receiving side of the print media stacker is to be aligned to a printer output; and further comprising a ramp moveable between a storage position and an operating position to guide the media sheet from the printer output to the pair of guiding tracks when in the operating position.

11. The print media stacker of claim 9, further including a print media tray which is arranged removably above the pair of guiding tracks.

12. A method of stacking print media exiting from a large format printer, the method comprising:

feeding a print media sheet from a printer output to a pair of support rails located along opposite sides of a media transport path, downstream of the printer output;

letting a trailing edge of the print media sheet drop on a downstream end of the pair of support rails;

the dropping of the trailing edge of the print media sheet causing a latch device to release a lock, wherein the latch device comprises a spring to be actuated by the media sheet contacting the spring; and the releasing of the lock enabling the pair of support rails to move, wherein movement of the support rails allows the print media sheet to drop from the pair of support rails.

13. The method of claim 12, wherein the pair of support rails move in response to gravity force of the print media sheet applied to the support rails.

* * * * *